United States Patent [19]

Swartz et al.

[11] Patent Number: 4,722,781

[45] Date of Patent: Feb. 2, 1988

[54] DESALTING PROCESS

[75] Inventors: Charles J. Swartz; Ardis L. Anderson, both of Ponca City, Okla.

[73] Assignee: Conoco Inc., Ponca City, Okla.

[21] Appl. No.: 893,833

[22] Filed: Aug. 6, 1986

[51] Int. Cl.[4] ..... C10G 33/04; C10G 33/00

[52] U.S. Cl. ..... 208/188; 208/187; 208/189; 208/262; 208/177; 210/712; 210/708

[58] Field of Search ..... 208/187, 180, 262, 177; 210/712, 708

[56] References Cited

U.S. PATENT DOCUMENTS

| | | | |
|---|---|---|---|
| 2,446,040 | 7/1948 | Blair, Jr. | 208/251 R |
| 3,396,100 | 8/1968 | Pettefer | 208/177 |
| 3,441,499 | 4/1964 | Francis, Jr. et al. | 208/187 |
| 3,453,205 | 7/1969 | Frances, Jr. et al. | 208/187 |
| 3,666,828 | 5/1972 | Post et al. | 208/187 |
| 4,200,550 | 4/1980 | Scherer et al. | 208/188 |
| 4,444,654 | 4/1984 | Cargle et al. | 208/187 |
| 4,551,239 | 11/1985 | Merchant et al. | 208/187 |
| 4,582,593 | 4/1986 | Bialek | 208/187 |

*Primary Examiner*—Patrick P. Garvin, Sr.
*Assistant Examiner*—Helane M. Myers

[57] ABSTRACT

In the desalting of crude oil, water-insoluble solids such as rust, iron sulfide, silt, clay, drilling mud components, etc., contained in the crude accumulate in an interfacial emulsion layer or cuff between the desalted crude and water phases. The major portion of this cuff is recycled to the crude feed and the remainder is mixed with a light diluent oil to break the emulsion and then settled to separate the crude and the water. The water-insoluble solids separate with the water. The separated oil phase may be combined with the desalted crude.

21 Claims, 1 Drawing Figure

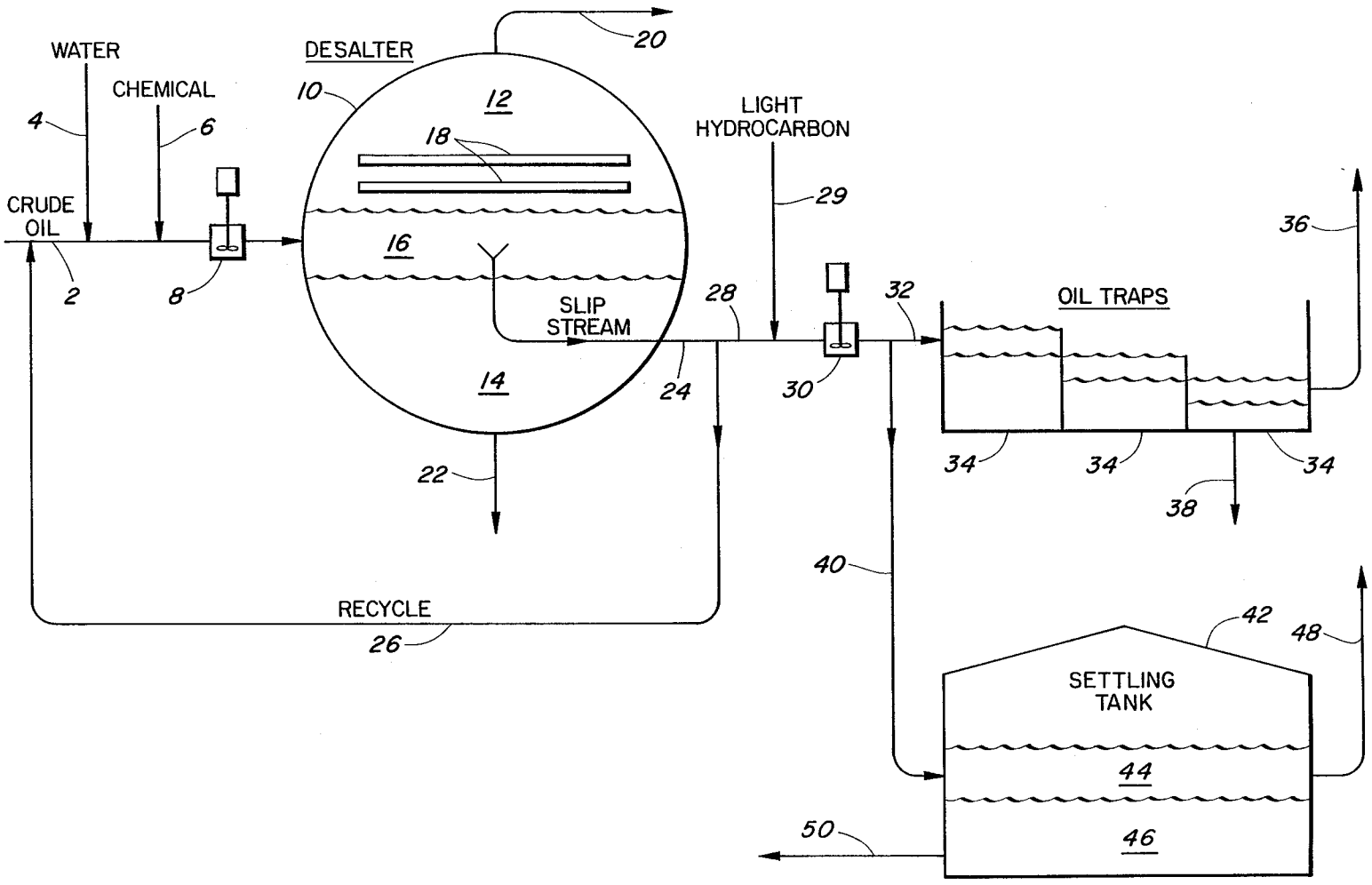
WATER
CHEMICAL
CRUDE OIL
DESALTER
LIGHT HYDROCARBON
SLIP STREAM
RECYCLE
OIL TRAPS
SETTLING TANK
2
4
6
8
10
12
14
16
18
20
22
24
26
28
29
30
32
34
36
38
40
42
44
46
48
50

DESALTING PROCESS

BACKGROUND AND SUMMARY OF INVENTION

Desalting of crude oil before it enters the various refinery processing units has been a common practice for many years. It is a purifying process to remove water, salts, silts, clays and other inorganic materials such as rust, iron sulfide, etc. Through the removal of such materials, a cleaner crude oil is charged to the refinery processing units. This operation prevents or reduces costly problems due to corrosion, fouling of the refinery equipment and accelerated catalyst poisoning. Higher quality products are also produced. Other benefits from desalting are less frequent turnarounds and savings in chemical treatment.

Until the recent years, crude desalting in plant units was a rather routine and simple operation. A relatively small amount of water was mixed well with the crude and the emulsion separated in a vessel using an electrostatic field to accelerate the coalescence of the water. Demulsifiers were used on crudes that possessed some emulsion stability. The desalted crude was sent to the downstream units for processing to quality products. Generally desalters worked well, required little attention and were almost a forgotten unit. This situation has changed.

Two factors affecting desalter operation have entered the scene in the last few years. The first relates to chemicals added to crude oil. Certain producers of crude oil are now using what is considered third-generation technology to further extract oil from oil-producing formations. Various chemicals, such as sulfonates, are employed to recover this tertiary oil. While producers have some concern regarding chemicals they use and their effect on refinery processing, their primary objective is to produce more oil. Processing problems, then, fall upon the refiners to handle. Although tertiary crude production has been relatively small compared to primary and secondary production, refiners have been burdened with some thorny problems by this oil.

The second factor relating to difficulties in plant desalter operation concerns processing heavier crudes. Generally, process desalting of crudes of about 30°API and lighter presents little or no problems. As crudes get heavier (particularly 20°API and heavier), water separation is slowed and producing a clean desalted product can be difficult. The settling rate of water droplets in a desalter follows Stokes Law which shows that the water settling rate decreases as the difference between the water and oil density narrows and as the viscosity of the oil increases. To some limit, heat can be applied to reduce the oil viscosity but this has little effect on the phase density difference. Heavy feedstocks, then, can be troublesome to desalt.

It is generally recognized that water-insoluble solids such as rust, iron sulfide, silt, clay, drilling mud components, etc., complicate the demulsification process. These materials tend to collect at the interface between the oil and water and contribute to emulsion stability. This material accumulates in a portion of the emulsion to form what is referred to as a cuff or rag layer. Emulsifiers used in drilling muds and surfactants used in tertiary production more than likely contribute to this problem.

It is desirable in desalting operations to produce an effluent water free of hydrocarbons—at least to the extent possible. This means that the cuff or rag layer is ultimately forced overhead in the desalted crude at the rate at which it is produced. This produces desalted crude of unacceptable quality which at least in part defeats the purpose of the desalting operation.

According to this invention heavy crude oils or their fractions, containing water-insoluble contaminants which are difficult to desalt because clean splits cannot be obtained due to a cuff layer emulsion which collects at the oil-water interface are processed by removing the cuff layer, recycling a major portion to the crude oil feed and drawing off a slip stream to avoid solids contaminant buildup. The slip stream is diluted with a light hydrocarbon material to break the emulsion and thereafter the oil reduced in solids content is recovered by settling and decantation. In one aspect of the invention the oil phase and cuff layer are removed together from the desalter and taken to a second vessel in which they are separated. The cuff layer is then processed as set forth above.

PRIOR ART

U.S. Pat. No. 3,396,100 relates to a process for separating an oil-water mixture. In this patent an interfacial cuff found between the oil and water is demulsified by diluting it with a soluble hydrocarbon such as kerosene or naphtha.

U.S. Pat. No. 4,200,550 discloses the processing of a stable emulsion which is formed at the water-oil interface during desalting operations. The emulsion is withdrawn from the desalter and is broken by the addition of a specific demulsifier.

U.S. Pat. No. 2,446,040 teaches the introduction of kerosene, water and a demulsifier upstream from a desalter.

In addition to the above-mentioned patents, there are literature references which describe recycling of the cuff or rag layer to the desalter.

BRIEF DESCRIPTION OF THE DRAWING

The FIGURE is a schematic diagram illustrating a desalter and a settling apparatus suitable for carrying out the invention.

DETAILED DESCRIPTION OF THE INVENTION

Referring to the drawing, a crude oil or fraction thereof containing water insoluble solids is introduced to the system through line 2. In addition to solids, the crude may contain emulsifiers used in drilling muds and surfactants which are employed in tertiary production of oil. Included in the solids which are present in the crude are such materials as salts, silts, clays, and other inorganic materials such as rust and iron sulfide. As the incoming crude oil passes through line 2 it is joined by about 1 to about 15 percent by volume of fresh water which is delivered to the system through line 4. A chemical demulsifying agent may also be introduced through line 6 if desired. This chemical agent may be an alkali such as sodium hydroxide or any of the well-known organic demulsifying agents that will act to destabilize the oil-water mixture in the desalter and facilitate its separation into oil and water. The oil, water and demulsifier, if present, are thoroughly mixed in mixer 8 or another suitable mixing device and are thereafter introduced into desalter 10. In the desalter the oil-water mixture separates into an oil layer 12 and a lower water layer 14. Separation of the mixture can be facilitated by disposing electric grids 18 in the oil zone and maintaining these grids at different potentials to establish a higher voltage electrostatic field between them.

Ideally the oil-water mixture introduced to desalter 10 would separate into an oil body substantially free of dispersed water and a body of water containing salts, water-soluble materials and water insoluble materials of the incoming oil-water mixture but substantially free of oil droplets. Unfortunately the oil-water systems treated in this invention do not so separate. Instead an interfacial cuff or rag material 16 forms between the water and the oil phases. This material which consists of crude oil, water, soluble salts, and water insoluble solids such as rust, iron-sulfide, silt, etc. accumulates and builds up in height to such an extent as to decrease the volumes available for the oil and water phases and may even prevent the continued separation of oil and water. To alleviate this problem, interfacial cuff material which is in the form of an emulsion is withdrawn from the desalter through line 24 24 and is recycled through line 26 to the crude oil feed to the desalter. The amount of interfacial cuff withdrawn is such as to maintain a suitable volume of oil and water phases in the desalter. Oil and water are withdrawn from these phases through lines 20 and 22, respectively.

When the recycled material combines with the large quantity of crude oil, the cuff emulsion is broken. Since fresh crude oil continues to bring more and more solids into the system, it is necessary, to avoid carryover of solids in the desalted crude, to remove these materials by some other method. This removal is effected by withdrawing a slip stream of the cuff material 16 through line 28. The cuff material is combined with a light hydrocarbon diluent introduced through line 29 to break the emulsion. The light hydrocarbon diluent may comprise any petroleum fraction of higher API gravity than the crude oil entering the desalter. Kerosene and naphtha are preferred diluents but other petroleum fractions boiling in the range of about 150° F. to about 625° F. can be satisfactorily employed. Such materials are readily soluble in the oil of the interfacial cuff material. If desired, a small amount of an organic chemical demulsifying agent may be added to the mix but this is not essential to the effectiveness of the process.

The amount of interfacial cuff withdrawn in the slip stream will usually be only a small fraction of the recycle. The amount will be governed by the equilibrium contaminant level in the desalted crude that is acceptable. For example, if the iron level in the crude may be maintained at about 10 times the current concentration in the cuff material then 9 volumes of cuff material would be recycled for each one volume of such material withdrawn as the slip stream. The amount of diluent used will vary depending on the composition of the interfacial cuff material. Usually the diluent will be between about 3 and about 10 volumes per volume of cuff material.

The slip stream-light hydrocarbon mixture is passed through mixer 30 to aid in breaking the emulsion and enters a series of oil traps 34 via line 32. In these oil traps the oil and water successively separate into separate bodies with the oil being withdrawn through line 36 and the water containing solids through line 38. Ordinarily the oil would be combined with crude leaving the desalter through line 20 but maybe separately processed if desired. In some instances oil traps such as 34 may not provide sufficient settling time to effect complete separation of oil and water. In this event the mixture of cuff material and light hydrocarbon can be processed in a larger settling tank by switching them through line 40 to tank 42. In tank 42 separation takes place to provide an oil phase 44 which is withdrawn through line 48 and a water phase containing solids 46 which is withdrawn through line 50.

In one aspect of the invention (not shown in the drawing) the oil phase 12 and cuff layer 16 are taken overhead together from the desalter 10 and introduced to another vessel where they collect as separate phases. The oil phase is removed from this vessel and subjected to further processing as desired. The cuff layer is separately withdrawn and processed as described in the discussion of the drawing.

EXAMPLE 1

60,000 barrels/day of heavy crude oil is electrostatically desalted in a horizontal vessel 28 feet long and 14 feet in diameter. The crude contains 50 to 100 ppb salt and 0.5 to 2.0 BS+W containing metal salts, silts, clays and other inorganic materials. The crude is combined with 4 percent by volume of fresh water and passed through a mixer before being introduced into the desalting vessel at a temperature of about 200° F. As an aid to desalting a chemical demulsifying agent in the amount of one part per ten thousand parts of oil is added to the oil.

An interfacial cuff forms in the desalter between the oil and water phases. This material contains desalted crude oil, water and concentrated solids and contaminants. Its structure is that of a simple emulsion with sufficient internal phase volume to give it plastic properties such as those of mayonnaise.

The thickness of the interfacial cuff is controlled by continuously withdrawing a portion of this material from the desalter and recycling it to the crude feed to break the emulsion. To prevent buildup of solids in the cuff and reduce solids contamination of the desalted crude a slip stream of the cuff material about 10 percent by volume is withdrawn from the recycle stream.

The slip stream is combined with about four volumes of kerosene to break the cuff emulsion and transferred through a mixer to a settling tank where the oil and water collect in separate phases. The water phase, which contains the major portion of the solids and other contaminants is withdrawn from the settling tank and discarded. The oil is also withdrawn and combined with the crude from the desalter for further processing. The desalted crude has a salt content of 5–10 ppb of salt and contains 0.2–0.5 BS+W. The major portion of the metal salts, silts, clays and other inorganic materials are removed from the desalted crude in the slip stream of interfacial cuff.

EXAMPLE 2

Two samples of crude oil were desalted in the laboratory by vigorous contact with water. Desalting was carried out with and without the addition of Nalco 5551 demulsifier. A material balance for the tests is presented in Table 1.

TABLE 1

| Charge | Yield Data | |
|---|---|---|
| | Without Demulsifier | With Demulsifier |
| Sample 1 - Crude Oil - 1500 ml (1230 gm)<br>Water - 90 ml (90 gm) | | |

TABLE 1-continued

| Charge | Yield Data Without Demulsifier | With Demulsifier |
|---|---|---|
| Desalted Crude Phase | 1500 ml (1230 gm) | 1500 ml (1230 gm) |
| Cuff Layer | 5.95 gm | 6.34 gm |
| Water Phase | 83.5 ml (gm) | 84.0 ml (gm) |
| Sample 2 - Crude Oil - 1500 ml (1230 gm) Water - 90 ml (gm) | | |
| Desalted Crude Phase | 1490 ml (1221 gm) | 1490 ml (1219 gm) |
| Cuff Layer | 20.0 gm | 19.8 gm |
| Water Phase | 79.0 ml (gm) | 81.0 ml (gm) |

Analyses of the metal content of the crude oil samples, desalted crude phases, cuff layers and water phases are presented in Table 2 for Sample 1 and Table 3 for Sample 2.

TABLE 2

| | Test No. | Fe | Si | Na | K | Ca | Mg | Ash (Wt %) |
|---|---|---|---|---|---|---|---|---|
| | | ppm | | | | | | |
| Crude Oil | 1 | 1.4 | <2.4 | 2.1 | 0.05 | 0.90 | 0.09 | <0.010 |
| Crude Oil | 2 | 1.8 | <2.4 | 8.9 | 0.27 | 3.9 | 0.69 | <0.010 |
| Desalted Crude Oil | 1 | 1.0 | <2.4 | 0.64 | <0.05 | 0.23 | 0.05 | <0.010 |
| Desalted Crude Oil | 2 | 0.6 | <2.4 | 2.4 | <0.04 | 0.58 | 0.10 | <0.010 |
| Cuff Layer | 1 | 190 | 35 | 1,100 | 14 | 330 | 48 | 0.42 |
| Cuff Layer | 2 | 160 | 40 | 2,300 | 30 | 740 | 94 | 0.88 |
| Water | 1 | <0.1 | <2.4 | 73 | 0.29 | 5.0 | 0.82 | 0.019 |
| Water | 2 | <0.1 | 3.1 | 68 | 0.81 | 12 | 2.1 | 0.021 |

Run 1 = Crude Oil Before Demulsifier Added
Run 2 = Crude Oil After Demulsifier Added

TABLE 3

| | Test No. | Fe | Si | Na | K | Ca | Mg | Ash (Wt %) |
|---|---|---|---|---|---|---|---|---|
| | | ppm | | | | | | |
| Crude Oil | 1 | 12 | <2.0 | 58 | 0.71 | 13 | 2.5 | 0.030 |
| Crude Oil | 2 | 14 | <2.0 | 55 | 0.69 | 13 | 2.5 | 0.029 |
| Desalted Crude Oil | 1 | 0.37 | <2.0 | 0.49 | <0.03 | 0.19 | 0.21 | 0.004 |
| Desalted Crude Oil | 2 | 1.1 | <2.0 | 1.6 | <0.03 | 0.58 | 0.09 | 0.002 |
| Cuff Layer | 1 | 46 | 8.0 | 73 | 1.4 | 16 | 3.0 | 0.10 |
| Cuff Layer | 2 | 110 | 8.0 | 280 | 5.3 | 67 | 12 | 0.17 |
| Water | 1 | 0.78 | 13 | 720 | 5.0 | 160 | 8.0 | 0.097 |
| Water | 2 | 0.29 | <2.0 | 470 | 7.4 | 12 | 11 | 0.053 |
| Deionized Water | — | <0.05 | <2.0 | 0.63 | 0.02 | 0.21 | 0.06 | — |

Run 1 = Crude Oil Before Demulsifier Added
Run 2 = Crude Oil After Demulsifier Added It is apparent from the analyses that the major portion of the metals concentrates in the cuff layer and may be removed from the system by the method of this invention.

We claim:

1. In a process wherein an oil-water mixture containing water-insoluble solids is introduced continuously into a separating zone to produce an upper oil phase, a lower water phase and an interfacial cuff emulsion containing water-insoluble solids, and wherein oil and water are withdrawn from the oil phase and water phase respectively, the improvement comprising:

(a) withdrawing said interfacial cuff emulsion from said separating zone;

(b) recycling a major portion of said withdrawn cuff emulsion back to said separating zone;

(c) treating the remaining portion of said withdrawn cuff emulsion with a diluent oil having a higher API gravity than that of the oil in said cuff emulsion, whereby said cuff emulsion is broken to form an oil phase and a water phase containing solids; and (d) recovering said oil phase step (c).

2. The process of claim 1 in which the oil in the oil water mixture is a salty crude oil containing water insoluble solids.

3. The process of claim 2 in which the diluent oil is a petroleum fraction boiling between about 150° and about 625° F.

4. The process of claim 3 in which the diluent oil is a petroleum naphtha.

5. The process of claim 3 in which the diluent oil is kerosene.

6. The process of claim 5 in which a chemical demulsifying agent is added prior to mixing the interfacial cuff emulsion with the diluent oil.

7. In the desalting of salty crude oil containing water-insoluble solids in which the crude oil is mixed with between about one and about fifteen percent by volume water, the resulting mixture is introduced to a separating zone where it separates into an upper oil phase, a lower water phase, and an interfacial cuff emulsion containing water-insoluble solids, and in which oil and water are withdrawn from the oil phase and water phase respectively, the improvement comprising:

(a) withdrawing said interfacial cuff emulsion;

(b) combining a major portion of said withdrawn cuff emulsion with said salty crude oil prior to mixing said salty crude oil with water;

(c) mixing the remaining portion of said withdrawn cuff emulsion with a diluent oil having an API gravity greater than that of said salty crude oil whereby said remaining portion of said cuff emulsion is separated into an oil phase and a water phase containing water-insoluble solids; and (d) recovering the oil phase from step (c).

8. The process of claim 7 in which separation of the salty crude oil-water mixture is effected by coalescing the water electrically.

9. The process of claim 8 in which a chemical demulsifying agent is used to aid in the separation of the salty crude oil-water mixture.

10. The process of claim 8 in which the diluent oil is a petroleum naphtha.

11. The process of claim 8 in which the diluent oil is kerosene.

12. The process of claim 11 in which a chemical demulsifying agent is used to aid in the separation of the interfacial cuff emulsion into oil and water phases.

13. The process of claim 12 in which the amount of diluent oil is between about 3 and about 10 times the volume of the interfacial cuff emulsion.

14. The process of claim 13 in which separation of the interfacial cuff emulsion into oil and water phases is effected in a settling zone.

15. The process of claim 14 in which separation of the interfacial cuff emulsion into oil and water phases is effected in a series of settling zones.

16. A process for recovering oil from an oil-water mixture containing water-insoluble solids comprising:

(a) introducing said mixture into a first separation zone to form an upper oil phase, a lower water phase and an interfacial cuff emulsion containing water-insoluble solids;

(b) withdrawing water from said first separation zone;

(c) withdrawing oil and said interfacial cuff emulsion together from said first separation zone and introducing said withdrawn oil and cuff emulsion into a second separation zone where said oil and said cuff emulsion collect as separate phases;

(d) withdrawing oil from said second separation zone;

(e) withdrawing cuff emulsion from said second separation zone;

(f) returning a major portion of said cuff emulsion from step (e) to the oil used to form said oil-water mixture;

(g) mixing the remaining portion of said cuff emulsion with a diluent oil having an API gravity higher than that of said oil in said oil-water mixture to break said cuff emulsion and to form an oil phase and a water phase containing accumulated solids; and (h) recovering said oil phase from step (g).

17. The process of claim 16 in which the oil in the oil water mixture is a salty crude oil containing water insoluble solids.

18. The process of claim 17 in which the diluent oil is a petroleum fraction boiling between about 150° and about 625° F.

19. The process of claim 18 in which the diluent oil is a petroleum naphtha.

20. The process of claim 18 in which the diluent oil is kerosene.

21. The process of claim 20 in which a chemical demulsifying agent is added prior to mixing the interfacial cuff emulsion with the diluent oil.

* * * * *